US005113541A

United States Patent [19]

Johenning

[11] Patent Number: 5,113,541

[45] Date of Patent: May 19, 1992

[54] WATERBED CORNER STRUCTURE

[75] Inventor: John B. Johenning, Beverly Hills, Calif.

[73] Assignee: Strata Flotation, Inc., Torrance, Calif.

[21] Appl. No.: 569,095

[22] Filed: Aug. 17, 1990

Related U.S. Application Data

[60] Continuation-in-part of Ser. No. 470,163, Jan. 25, 1990, which is a division of Ser. No. 395,715, Aug. 18, 1989, Pat. No. 4,930,172.

[51] Int. Cl.[5] ..... A47C 27/08

[52] U.S. Cl. ..... 5/451; 156/297

[58] Field of Search ..... 5/451, 508, 460, 474, 5/449, 450, 452, 498; 24/72.5; 428/79, 192; 156/245, 297

[56] References Cited

U.S. PATENT DOCUMENTS 4,393,531 7/1983 Hodel ..... 5/451

4,914,761 4/1990 Boyd ..... 5/451

4,930,172 6/1990 Johenning ..... 5/451

OTHER PUBLICATIONS

"Naturalizer" A Trade Brochure of the Land and Sky Manufacturing Co., Lincoln, Nebraska ©1989.

*Primary Examiner*—Alexander Grosz

*Attorney, Agent, or Firm*—Flehr, Hohbach, Test, Albritton & Herbert

[57] ABSTRACT

Corner structure for a waterbed mattress and liner in which a cornerpiece is formed as a monolithic structure with a relatively thick base plate and relatively large ridges or cleats projecting from the front surface of the base plate. The base plate has a peripheral sealing area which is affixed by heat sealing to the walls of the mattress or liner to form the corner, and the base plate is formed of a material which is pliant enough to conform to the contour of the mattress and tough enough to resist puncturing. The ridges or cleats help to keep bedsheets in place on the mattress.

14 Claims, 4 Drawing Sheets

FIG__9
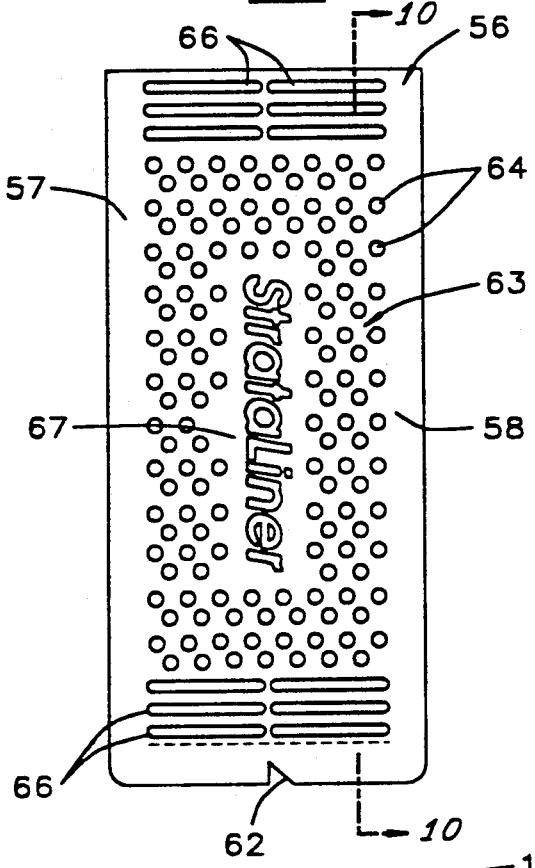
FIG__10
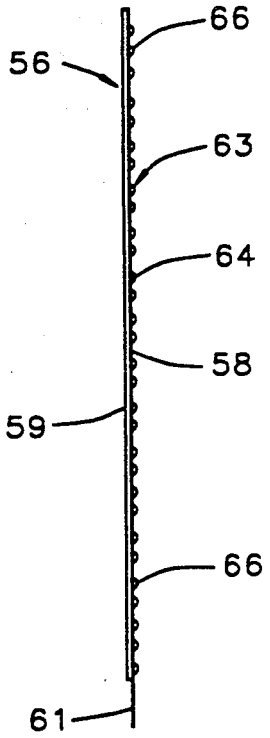
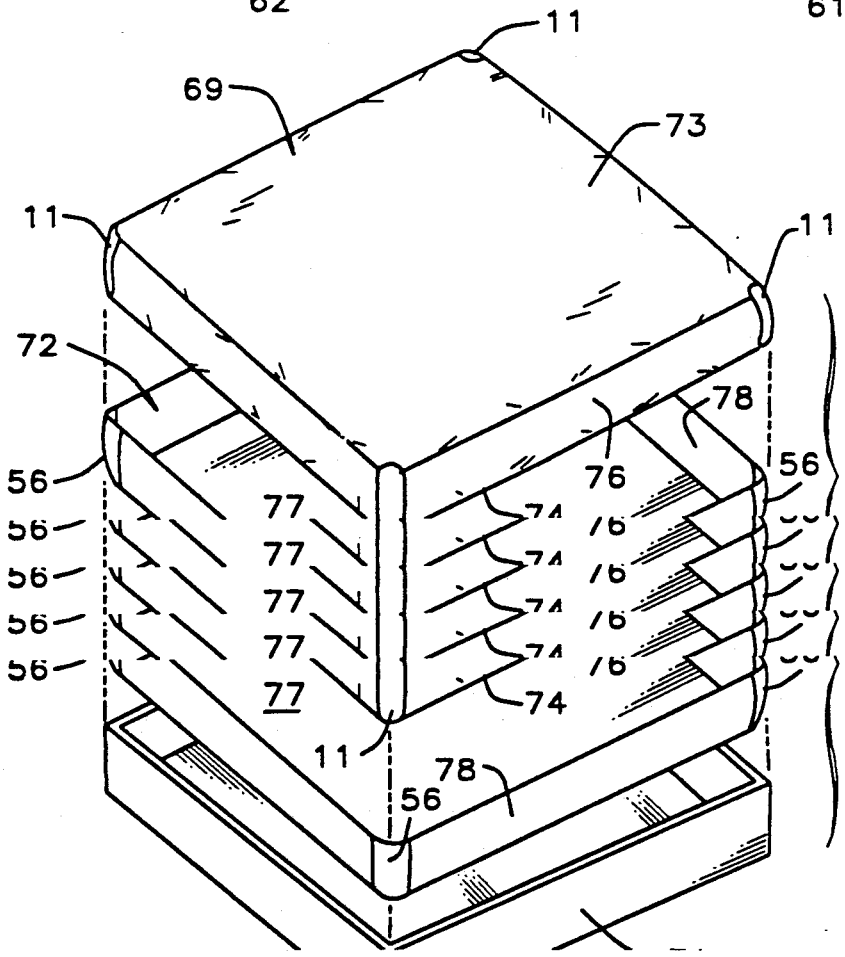
FIG__11
FIG__11
FIG__11
FIG__11
FIG__11

WATERBED CORNER STRUCTURE

This is a continuation-in-part of Ser. No. 470,163, filed Jan. 25, 1990, which is a division of Ser. No. 395,715, filed Aug. 18, 1989, now U.S. Pat. No. 4,930,172.

This invention pertains generally to waterbeds and, more particularly, to a corner structure for waterbed mattresses and liners.

In its simplest form, a waterbed mattress consists of two generally rectangular sheets of a material such as polyvinylchloride which are sealed together along their edges to form an enclosure. When this enclosure is filled with water, it assumes a three dimensional shape which has a depth as well as a length and a width. Because of the simple peripheral seam, the corners of a mattress made in this manner tend to be rounded rather than square.

Other waterbed mattresses have been made with contoured or fitted corners. In these mattresses, the enclosure is typically formed with a corner structure having a height corresponding to the depth of the mattress so that the mattress will have substantially square corners when it is filled with water.

To prevent damage in the event of a leak in the mattress, waterbeds are commonly provided with safety liners. Such liners typically consists of a sheet of vinyl or other water impervious material which extends beneath and along the sides of the mattress to form a water-tight coffer for containing any water which may escape from the mattress. The upper edges of the liner are typically attached to the peripheral frame of the bed by staples, tape or other suitable means to hold the liner in place.

A common cause of leaks in waterbeds is puncturing of the mattress, for example, by staples used to hold the liner in place or by screws or nails used to hold the frame together. The corners of a mattress are particularly vulnerable to this problem since that is where the majority of the metal fasteners and other sharp objects are generally found.

Heretofore, there have been some efforts to provide waterbed mattresses with corners which will resist puncturing. In one such approach, layers of vinyl film are laminated together to form a cornerpiece, and the laminated structure is attached to the walls of the mattress by heat sealing. Raised lettering and a peripheral bead are formed in the cornerpiece by recesses in the sealing die. The lettering and bead are relatively flat, and they are primarily decorative. Moreover, the thickness of the laminated structure is not uniform, and this makes it difficult to get a uniformly good heat seal between the cornerpiece and the mattress walls.

It is in general an object of the invention to provide a new and improved corner structure for waterbed mattresses and liners.

Another object of the invention is to provide a corner structure of the above character which overcomes the limitations and disadvantages of corner structures heretofore provided.

These and other objects are achieved in accordance with the invention by forming a cornerpiece for a waterbed mattress or liner as a monolithic structure comprising a relatively thick base plate with relatively large cleats or ridges projecting from the front surface thereof. The base plate has a peripheral sealing area which is affixed by heat sealing to the walls of the mattress or liner to form the corner, and the base plate is formed of a material which is pliant enough to conform to the contour of the mattress and tough enough to resist puncturing. The ridges or cleats help to keep bedsheets in place on the mattress.

FIG. 9 is a front elevational view of another embodiment of a cornerpiece according to the invention which is particularly, suitable for use in a waterbed liner.

FIG. 10 is a cross-sectional view taken along line 10—10 in FIG. 9.

FIG. 11 is an exploded isometric view of one embodiment of a waterbed having a mattress and a liner with corner structures according to the invention.

Figure 1:
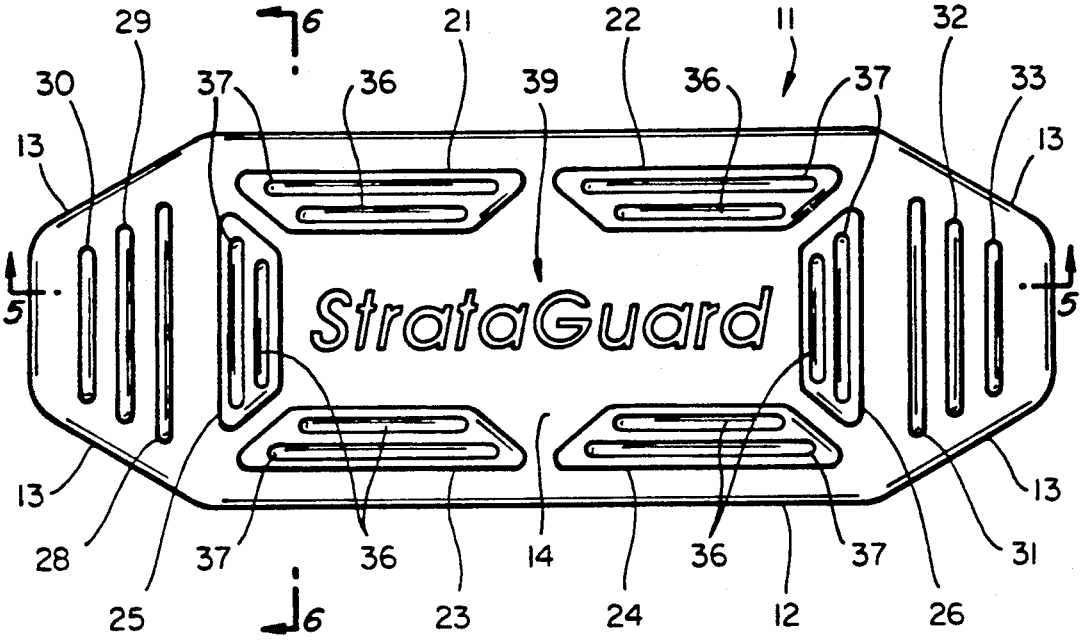
FIG. 1 is a front elevational view of one embodiment of a cornerpiece according to the invention which is particularly suitable for use in a waterbed mattress.
Figure 2:
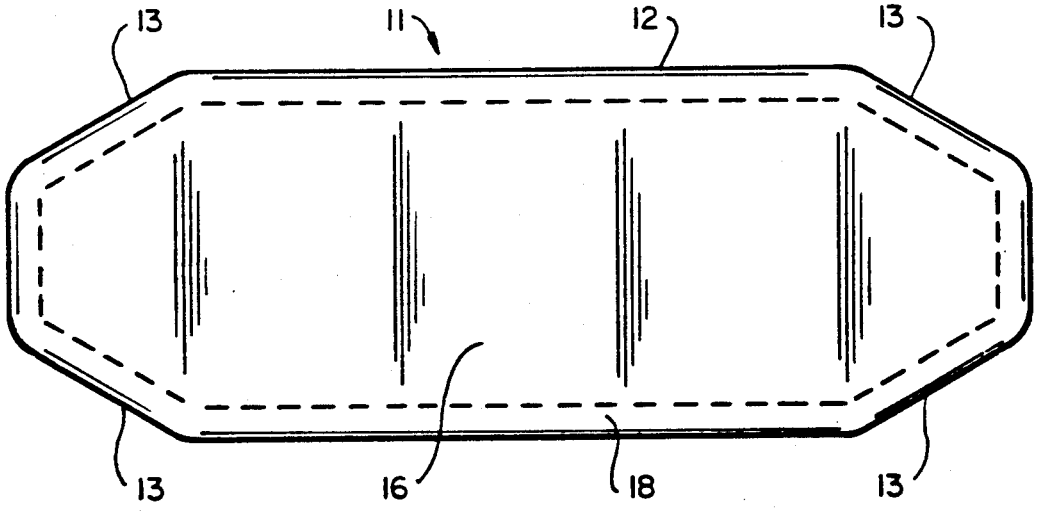
FIG. 2 is a rear elevational view of the embodiment of FIG. 1.
Figure 3:
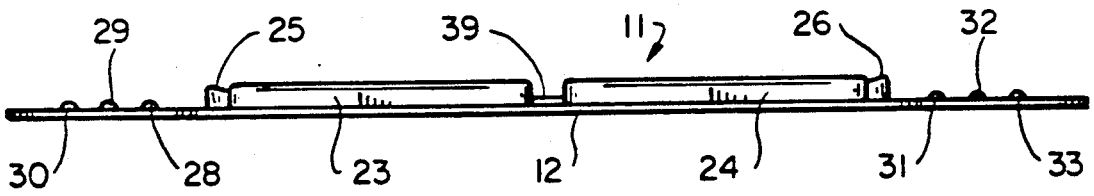
FIG. 3 is a side view of the embodiment of FIG. 1.
Figure 4:
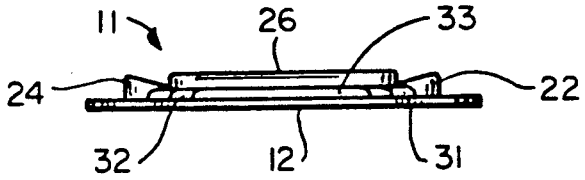
FIG. 4 is an end view of the embodiment of FIG. 1.
Figure 5:
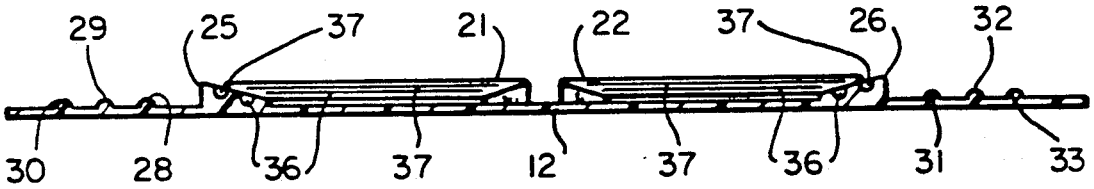
FIG. 5 is a cross-sectional view taken along line 5—5 in FIG. 1.
Figure 6:
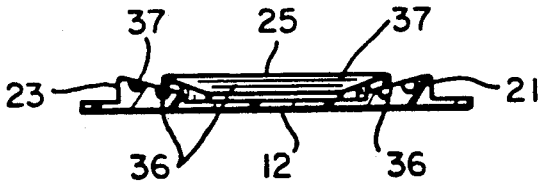
FIG. 6 is a cross-sectional view taken along line 6-6 in FIG. 1.

As illustrated in FIGS. 1-8, cornerpiece 11 has a generally rectangular base plate 12 with mitered corners 13. The base plate has front and rear surfaces 14, 16 which are generally flat or planar prior to installation, although the plate is fabricated of a pliant material which permits the cornerpiece to conform to the corner contour of the mattress in which it is installed. A peripheral sealing area 18 is provided on the back side of the base plate for attachment to the walls of a mattress to form the corner.

A plurality of relatively heavy ridges project from the front surface of the base plate. These ridges include elongated trapezoidal cleats 21-26 and raised beads 28-33. The cleats are arranged in a rectangular pattern, with cleats 21, 22 and 23, 24 extending longitudinally along opposite side margins of the base plate and cleats 25, 26 extending transversely between the outer ends of the longitudinally extending cleats. Beads 28-30 and 31-33 extend transversely of the tapered end portions of the base plate. Raised lettering 34 projects from the front surface of the base plate in the rectangular area bounded by the cleats.

The cleats have a generally triangular profile in cross section, and each of them has a pair of generally parallel grooves 36, 37 which extend longitudinally of the cleats. These grooves have a generally semicircular cross-sectional contour. The beads 28-33 decrease in length toward the ends of the base plate, and each of the beads has a semicircular profile in cross section.

The cleats, beads and raised lettering provide protection against punctures, as well as resistance to abrasion, and they also engage the bedsheets which are wrapped or tucked around the corners and thus help to retain the sheets in place on the mattress.

The base plate, cleats, beads and raised lettering are all formed as a monolithic structure by a suitable process such as injection molding. This process provides a rugged solid structure and is preferred to other processes such as vacuum forming or pressure forming which would produce an embossed effect with indentations in the rear surface behind the raised lettering and other protuberances on the front side of the base plate. The cornerpiece is preferably fabricated of a material which can be affixed to the walls of the mattress by heat sealing, is pliant enough to conform to the contour of the mattress and is tough enough to resist puncturing. The cornerpiece is generally fabricated of the same type of material as the rest of the mattress, and in a vinyl mattress, for example, the cornerpiece is fabricated of vinyl.

The cornerpiece has a heavy construction which provides good protection against puncturing and also provides a good grip on the bedsheets to help keep them in place, as well as being aesthetically pleasing. In one presently preferred embodiment, the cornerpiece has a length on the order of 8½ inches, a width on the order of 3¼ inches and a thickness on the order of 0.050 inch, with cleats 21-26 projecting about 0.110 inch along their outer edges, beads 28-33 projecting about 0.050 inch, and lettering 39 projecting about 0.040 inch. While 0.050 inch is currently a preferred thickness for the base plate, the base plate can have a thickness on the order of 0.020 to 0.080 inch for a mattress having a walls of 20 mil vinyl.

Figure 7:
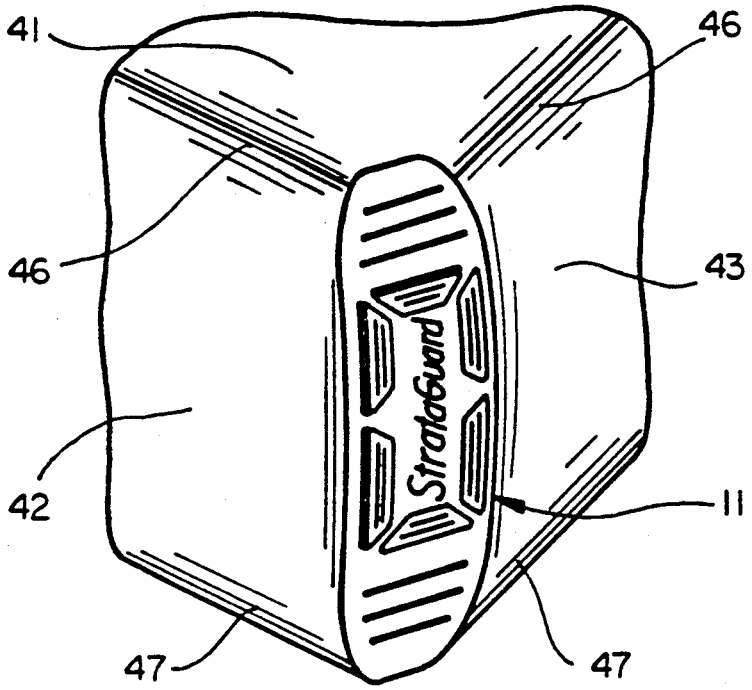
FIG. 7 is a fragmentary isometric view of a waterbed mattress with the cornerpiece of FIG. 1 installed therein.
Figure 8:
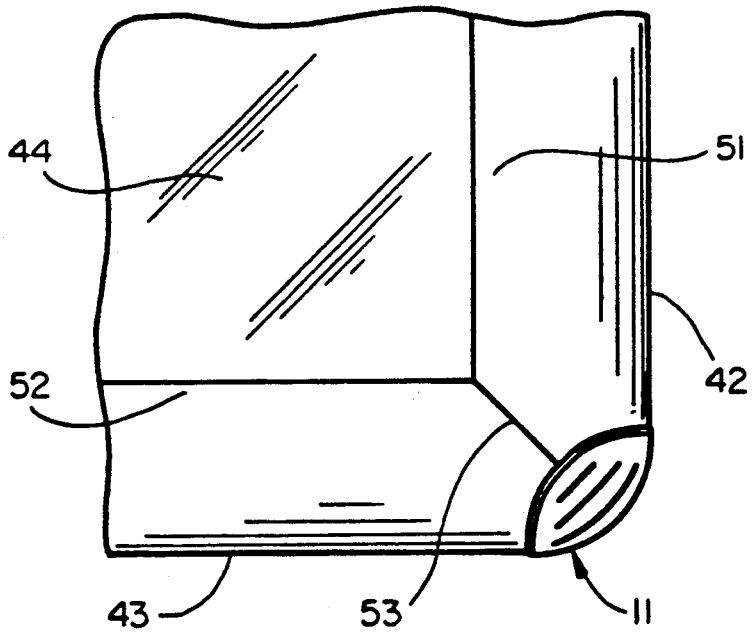
FIG. 8 is a fragmentary bottom plan view of the mattress of FIG. 7.

FIGS. 7-8 illustrate the cornerpiece 11 in connection with a mattress in which the top wall 41 and side walls 42, 43 are formed of a single sheet of material such as a 20 mil vinyl film, and the bottom wall 44 is formed of a separate sheet of a similar material. The sheet which forms top and side walls wraps around the upper and lower side edges 46, 47 and extends a short distance on the under side of the mattress where it is sealed to the rectangular sheet which forms the bottom wall. At the corner, the upper sheet is trimmed and heat sealed to the peripheral sealing area on the back side of the cornerpiece, and the portions 51, 52 of the sheet which extend on the under side of the mattress are sealed together along a diagonally extending line 53. The resulting corner structure is contoured or fitted, and the mattress has a generally square corner when filled with water, with the cornerpiece being gently curved in both horizontal and vertical directions.

Alternatively, if desired, the cornerpiece can be molded in the desired contour for the corner of the mattress, rather than being molded flat and formed into a three-dimensional contour by the water in the mattress and the frame of the bed. When the cornerpiece is molded with a three-dimensional contour, a three-dimensional die is required for sealing the cornerpiece to the walls of the mattress, but the resulting corner has a better contour than a corner having a flat cornerpiece.

The safety liner cornerpiece 56 illustrated in FIGS. 9-10 is similar to the cornerpiece for mattresses. It has a generally rectangular base plate 57 with front and rear surfaces 58, 59 which are generally flat or planar prior to installation. Base plate 57 also has a sealing area 61 of reduced thickness along the bottom and side margins thereof for attachment to the bottom and side panels of the liner. A triangular notch 62 is formed in the lower edge of the base plate to facilitate the formation of a three-dimensional corner when the corner-piece is attached to the panels.

A plurality of cleats 63 project from the front surface of base plate 57. These cleats include hemispherical cleats 64 arranged in a rectangular pattern, elongated cleats 66 which extend in a horizontal direction near the upper and lower edges of the base plate, and raised lettering 67 in the center of the rectangular area defined by the hemispherical cleats.

As in the case of the cornerpiece for mattresses, base plate 57 and cleats 63 are formed as a monolithic structure by a suitable process such as injection molding. Here again, this process provides a rugged solid structure and is preferred to other processes such as vacuum forming or pressure forming which would produce an embossed effect with indentations in the rear surface behind the raised lettering and other protuberances on the front side of the base plate. Cornerpiece 56 is preferably fabricated of a material which can be affixed to the panels of the liner by heat sealing, is pliant enough to conform to the contour of the mattress and is tough enough to resist puncturing. The cornerpiece is generally fabricated of the same type of material as the rest of the liner, and in a vinyl liner, for example, the cornerpiece is fabricated of vinyl. The cornerpiece is, however, substantially thicker and tougher than the rest of the liner, and in a liner having side and bottom panels fabricated of 10 mil vinyl, for example, base plate 57 can have a thickness on the order of 0.080 inch in the central area and 0.040 inch in the sealing area, with hemispherical cleats 64 projecting about 0.080 inch from the front surface of the base plate, elongated cleats 66 projecting about 0.040 inch and raised lettering 67 projecting about 0.050 inch.

As in the case of the cornerpiece for the mattress, the cornerpiece for the liner can be molded either flat or with a desired contour for the corners of the liner. When the cornerpiece is molded with a three-dimensional contour, a three-dimensional die is required for joining the cornerpiece to the panels of the liner, but the resulting corner has a better contour than a corner having a flat cornerpiece.

FIG. 11 illustrates a waterbed 69 which has a water-filled mattress 69, a rigid circumscribing frame 71 which provides lateral support for the body of water in the mattress, and a safety liner 72 positioned between the mattress and the frame. The mattress has a top wall 73, a bottom wall 74, and side walls 76, with cornerpieces 11 at the four corners thereof. The liner has a bottom panel 77 positioned beneath the mattress and side panels 78 extending in an upward direction from the periphery of the bottom panel, with a cornerpiece 56 at each of its corners. The side panels of the liner have inner and outer layers of vinyl with stiffeners of cardboard or other suitable material between the two layers to enable the panels to stand in an upright position without being attached to the frame of the bed. The cleats on the two cornerpieces at each corner of the bed face each other and interlock to provide a good grip on bedsheets tucked between the mattress and the liner. The cornerpieces on the liner provide additional protection against puncturing and abrasive wear, as well as providing a pleasing aesthetic appearance.

The invention has a number of important features and advantages. As noted above, cornerpieces protect the mattress from puncture and abrasive wear, and the cleats, beads and raised lettering help to hold bedsheets in position on the mattress. Being injection molded and formed as monolithic structures, the cornerpieces have a uniform thickness throughout their peripheral sealing areas, and this helps to assure a good seal between the cornerpieces and the walls of the mattress and the panels of a liner.

It is apparent from the foregoing that a new and improved structure and method for making the corners of a waterbed mattress have been provided. While only certain presently preferred embodiments have been described in detail, as will be apparent to those familiar with the art, certain changes and modifications can be made without departing from the scope of the invention as defined by the following claims.

I claim:

1. In a safety liner for containing water from the mattress of a waterbed: a base plate having generally planar front and rear surfaces and a peripheral sealing area attached to bottom and side panels of the liner, and a plurality of cleats projecting from the front surface for engagement with a bedsheet tucked between the mattress and the liner to help retain the bedsheet in position on the mattress.

2. The liner of claim 1 wherein the base plate and the cleats are formed as a monolithic structure of a material which is pliant enough to conform to the contour of the mattress and tough enough to resist puncturing.

3. The liner of claim 2 wherein the monolithic structure is formed by injection molding.

4. The liner of claim 1 wherein the base plate and the cleats are formed of vinyl.

5. In a safety liner for containing water from the mattress in a waterbed: a bottom panel adapted to be positioned beneath the mattress, side panels extending in an upward direction from the periphery of the bottom panel, and cornerpieces sealed to the bottom panel and the side panels to form contoured corners, each of said cornerpieces having a relatively thick base plate with a plurality of cleats projecting therefrom for engagement with a bedsheet tucked between the mattress and the liner to help retain the bedsheet in position on the mattress.

6. The safety liner of claim 5 wherein the baseplate and the cleats are formed as a monolithic structure.

7. The safety liner of claim 6 wherein the monolithic structure is formed by injection molding.

8. The safety liner of claim 6 wherein the panels and the cornerpieces are formed of vinyl.

9. In a waterbed: a water-filled mattress having relatively thick cornerpieces at the corners thereof, and a safety liner having a bottom panel positioned beneath the mattress, side panels extending upwardly from the bottom panel, and relatively thick cornerpieces sealed to the bottom panel and the side panels in registration with the cornerpieces of the mattress.

10. The waterbed of claim 9 wherein the cornerpieces of the mattress and the cornerpieces of the liner have cleats projecting therefrom for gripping engagement with a bedsheet tucked between the mattress and the liner.

11. In a method of making a corner in a waterbed liner having bottom and side panels, the steps of: forming a cornerpiece which is substantially thicker and tougher than the bottom and side panels, and sealing the cornerpiece to the bottom and side panels at a corner of the liner.

12. The method of claim 11 wherein the step of forming the cornerpiece includes forming cleats which project from a surface of the cornerpiece and are an integral part of the cornerpiece.

13. The method of claim 11 wherein the cornerpiece is formed with a three dimensional contour.

14. The method of claim 11 wherein the cornerpiece is formed by injection molding.

* * * * *